United States Patent [19]

Wilsberg

[11] Patent Number: 4,714,479

[45] Date of Patent: Dec. 22, 1987

[54] WASHING PROCESS FOR SENSITIVE FABRICS

[75] Inventor: Heinz-Manfred Wilsberg, Cologne, Fed. Rep. of Germany

[73] Assignee: Henkel Kommanditgesellschaft auf Aktien, Duesseldorf, Fed. Rep. of Germany

[21] Appl. No.: 5,312

[22] Filed: Jan. 16, 1987

Related U.S. Application Data

[63] Continuation of Ser. No. 757,968, Jul. 23, 1985, abandoned.

[30] Foreign Application Priority Data

Jul. 23, 1984 [DE] Fed. Rep. of Germany ..... 3427078

[51] Int. Cl.[4] ..... D06M 13/46; C11D 1/29

[52] U.S. Cl. ..... 8/137; 252/174.15; 252/544; 252/550; 252/DIG. 14

[58] Field of Search ..... 8/137; 252/550, DIG. 14, 252/117, 174.15, 544, 551, 552, 173, 550

[56] References Cited

U.S. PATENT DOCUMENTS

| | | | |
|---|---|---|---|
| 3,533,955 | 10/1970 | Pader et al. | 252/153 |
| 3,892,681 | 7/1975 | Edwards et al. | 252/551 |
| 3,985,687 | 10/1976 | Inamorato et al. | 252/551 |
| 4,075,118 | 2/1978 | Gault et al. | 252/130 |
| 4,092,272 | 5/1978 | Nishimura et al. | 252/544 |
| 4,371,461 | 2/1983 | Jones et al. | 252/547 |

FOREIGN PATENT DOCUMENTS

| | | |
|---|---|---|
| 2544242 | 8/1976 | Fed. Rep. of Germany . |
| 1529454 | 10/1978 | United Kingdom . |

OTHER PUBLICATIONS

CA 86/18757n.

*Primary Examiner*—Paul Lieberman
*Assistant Examiner*—Hoa Van Le
*Attorney, Agent, or Firm*—Ernest G. Szoke; Henry E. Millson, Jr.; Real J. Grandmaison

[57] ABSTRACT

Delicate fabrics of wool or silk are hand-washed or machine-washed using an aqueous detergent which is free from inorganic builder salts and optical brighteners and which shows a substantially neutral reaction, comprising (a) from 5 to 25% by weight of an alkyl glycol ether sulfate containing primary $C_{12}$–$C_{18}$-alkyl groups and from 1 to 3 ethylene glycol ether groups, (b) from 0.5 to 5% by weight of monoethanolamides of $C_{12}$–$C_{18}$-fatty acids, (c) from 0.1 to 1.0% by weight of an emulsified silicone defoamer, and water. In addition, the detergent may contain (d) up to 5% by weight of non-surface-active detergent additives, such as sequestrants, preservatives, dyes and perfumes. The treated fabrics have a soft feel.

21 Claims, No Drawings

WASHING PROCESS FOR SENSITIVE FABRICS

This application is a continuation of application Ser. No. 757,968, filed July 23, 1985 now abandoned.

BACKGROUND OF THE INVENTION

1. Field of the Invention

This invention relates to a washing process for delicate fabrics of wool or silk.

2. Description of Related Art

Detergents suitable for washing highly sensitive fabrics of wool or silk are known. Such known detergents generally show a neutral to mildly alkaline reaction and, in addition to anionic surfactants such as alkyl benzene sulfonate, fatty alcohol sulfate or alkyl glycol ether sulfate, often contain nonionic or cationic compounds. The nonionic surfactants are intended to increase detergency while the cationic compounds are intended to improve the softness and feel of the washed fabrics. However, it has been found that a number of anionic surfactants, such as alkyl benzene sulfonates for example, damage the fiber structure of sensitive, washable wools, particularly merino and angora, upon repeated use; whereas fatty alcohol sulfates, for example, do not wash satisfactorily at the low washing temperatures necessary. Nonionic surfactants have also proved to be unsatisfactory in such instances, because sensitive woolen fabrics washed with them feel comparatively hard and brittle. These effects can be considerably intensified with machine-washing. An addition of softening cationic surfactants, as recommended for purposes such as these, does not completely counteract the loss of feel and, where anionic surfactants are simultaneously present, leads to a reduction in detergency.

Additions of builder salts, such as pyrophosphates showing a mild alkaline reaction or free alkanolamine, have also been recommended for increasing detergency, but unfortunately their use likewise results in a loss of quality in the case of particularly sensitive woven or knitted woolen fabrics. Fatty acid mono- and diethanolamides are also known additives for light-duty detergents. However, their high foaming activity means that the wash liquor frequently overfoams when used in washing machines, particularly in automatic washing machines with a horizontally mounted drum. This applies in particular where foaming-active anionic surfactants are present.

DESCRIPTION OF THE INVENTION

Other than in the operating examples, or where otherwise indicated, all numbers expressing quantities of ingredients or reaction conditions used herein are to be understood as modified in all instances by the term "about."

An object of the present invention is to obviate the above-mentioned disadvantages. The present invention relates to a process for washing fabrics of wool or silk using a liquid detergent preparation which is free from inorganic builder salts and optical brighteners and which has a pH-value of from 6 to 8, and which contains (a) from 5 to 25%, preferably from 7 to 20%, and more preferably from 9 to 15% by weight of the sodium salt of an alkyl glycol ether sulfate of primary $C_{12}$–$C_{18}$- alcohols containing on average from 1 to 3 ethylene glycol ether groups, (b) from 0.5 to 5%, preferably from 1 to 4%, and more preferably from 1.5 to 3% by weight of a fatty acid monoethanolamide of $C_{12}$–$C_{18}$- fatty acids containing at least 50 mole % of saturated $C_{12}$–$C_{14}$-fatty acids, (c) from 0.1 to 1%, preferably 0.05 to 0.5% by weight of an emulsified silicone defoamer, (d) from 0 to 5% by weight of one or more non-surface-active non-alkaline detergent additives, and (e) remainder water, wherein the ratio by weight of component (a) to (b) is between 3:1 and 50:1, preferably between 3:1 and 25:1, and more preferably between 4:1 and 10:1.

Component (a) is derived from fatty alcohols or fatty alcohol mixtures of natural or synthetic origin which may be linear or, optionally, methyl-branched (oxo residue) in the 2-position. Suitable fatty alcohols are, preferably, lauryl, myristyl, cetyl and stearyl alcohol and mixtures thereof. The statistical average is preferably in the $C_{12}$ to $C_{14}$ range. The number of ethylene glycol ether groups amounts on a statistical average to between 1 and 3 and is preferably between 1 and 2, i.e., small quantities of non-ethoxylated alcohols or ethoxylates containing more than 3 glycol ether groups can also be present, as is normally the case where alkoxylation is carried out on an industrial scale. The sulfuric acid semiesters produced by sulfatization of these alkyl (poly) glycol ethers are present in the form of their sodium salt.

Component (b) is derived from fatty acids of natural or synthetic origin, preferably from natural fatty acid mixtures, such as coconut oil fatty acids (after separation of the fractions containing less than 12 carbon atoms). Suitable mixtures may contain, for example, lauric acid, myristic acid, palmitic acid, stearic acid, and oleic acid, although the proportion of saturated $C_{12}$–$C_{14}$-fatty acids should amount to at least 50 mole % and, preferably, to at least 60 mole %. The fatty acid monoethanolamides which are produced by reaction with monoethanolamine should not contain any free ethanolamine and should show a substantially neutral reaction. Accordingly, it is advisable to neutralize any alkaline reacting constituents which may still be present, preferably with organic acids, such as acetic acid, lactic acid, glycolic acid or citric acid, so that the pH-value of the preparation is preferably between 6.5 and 7.5.

Component (c) consists of an organopolysiloxane which is present in admixture with from 1 to 10% by weight, based on component (c), of a finely divided, preferably silanized silica, and from 1 to 10% by weight, based on component (c), of an emulsifier which provides for homogeneous distribution of the organopolysiloxane in water or in the aqueous mixture of components (a) and (b). Particularly suitable organopolysiloxanes are dimethyl polysiloxanes present in admixture with silanized silica and nonionic emulsifiers. Suitable emulsifiers are, for example, polyglycol ethers substituted by relatively long chain alcohols, alkyl phenols, fatty acids and fatty acid amides. Relatively high molecular weight, unsubstituted polyglycol ethers, block polymers of polyethylene glycol and polypropylene glycol and mixtures of the emulsifiers mentioned are also suitable. In general, the mixtures of dimethyl polysiloxane, silica and emulsifier are commercially available as ready-made products.

Other optional ingredients (component (d)) are non-surface-active and non-alkaline detergent additives, such as dyes and perfumes, preservatives, such as formalin for example, complexing agents for heavy metal traces, such as ethylene diaminetetraacetate for example, low molecular weight carboxylic and polycarboxylic acids for adjusting the pH-value and agents for regulating the viscosity of the aqueous concentrate, such as lower alcohols, glycerin or glycol ethers, and neutral salts, such as sodium chloride. Individually, these ingredients are present in quantities of less than 1% by weight and generally in quantities of less than 0.5% by weight. Their total quantity should not exceed 5% by weight.

The detergents used are in the form of aqueous, storable concentrates. In this form, they are particularly easy to dispense and to distribute uniformly in the washing solution. They can be used for both hand washing and also for machine washing, with machine washing preferred, especially since the preparation is particularly intended for that purpose. The preparations are suitable for washing highly sensitive fabrics, particularly knitted fabrics of wool and silk, including sensitive angora wool. In addition to an excellent washing result, these fabrics do not become hard, but instead retain their natural softness and their light, loose feel not only with hand washing, but also with machine washing in automatic washing machines using the so-called wool program.

Accordingly, the present invention also relates to a process for the mild washing of woolen fabrics in drum-type washing machines at a temperature in the range of from 20° C. to 40° C. and with a liquor ratio (kg of fabrics being washed per liter of wash liquor) of from 1:20 to 1:50, the fabrics being washed undergoing minimal mechanical stressing, where the washing is carried out with from 2 to 6 g/l of the above liquid detergent, and preferably wherein the liquid detergent has a pH-value of from 6.5 to 7.5.

The mechanical stressing which the textiles being washed undergo in the washing machine should be comparatively low at high liquor levels, which is generally guaranteed in automatic washing machines having a special wool program. The washing temperature is preferably in the range of 25° to 35° C. while the liquor ratio preferably amounts to between 1:25 to 1:40. Foaming problems, i.e., overfoaming of the wash liquor or heavy foaming during final rinsing with water, do not arise.

EXAMPLES

EXAMPLE 1

A solution of 10 kg of sodium alkyl glycol ether sulfate (2 ethylene glycol ether groups, cocosalkyl residues, chain length 55% $C_{12}$, 22% $C_{14}$, 11% $C_{16}$ and 12% $C_{18}$) in 84 kg of water was heated to 85° C. After the addition of 2 kg of coconut oil fatty acid monoethanolamide, 200 g of glycerin and 1 kg of glycol distearate (nacreous opacifier), homogenization and cooling of the solution to 30° C., 100 g of sodium ethylene diaminetetraacetate and 600 g of a 20% by weight aqueous silicone defoamer emulsion (Polymekon WM 20, a product of Goldschmidt, Essen, Federal Republic of Germany) were added, corresponding to an addition of 120 g of pure anhydrous silicone defoamer. 1200 g of defoamer emulsion DB 110 A, a product of DOW-CORNING, USA (active substance content 10% by weight) may also be used in the same way. After the addition of 100 g of a 30% formalin solution (preservative), 1 kg of perfume oil and 500 g of sodium chloride, the solution was adjusted to pH 7 with 100 g of citric acid. The final liquid detergent had a total water content of 84.9% by weight. The solution was stable in storage and unaffected by low temperatures.

EXAMPLE 2

A stable aqueous solution was prepared in the same way as in Example 1 from the following components (in % by weight):

15.0% of Na cocosalkyl diglycol ether sulfate,
4.0% of coconut oil fatty acid monoethanolamide,
1.2% of defoamer emulsion (DB 110A)
0.3% of glycerin,
0.1% of EDTA-Na,
2.0% of glycerin monostearate,
0.1% of formalin solution,
0.1% of citric acid, remainder water; pH-value 7.

The products were tested under the following conditions on pullovers of 50% angora and 50% lambs wool:

| | Hand washing | Machine washing |
|---|---|---|
| Concentration (g/l) | 3.5 | 2 |
| Liquor ratio (kg/l) | 1:10 | 1:30 |
| Temperature (°C.) | 30° | 30° |
| Washing time (mins.) | 2 | 15 |

Machine washing was carried out in an automatic washing machine having a horizontally mounted drum using the wool program. Foaming was moderate, i.e., the empty space above the liquid was half-filled with foam. Foaming during rinsing was very slight in the first rinse and did not occur in the second and third rinses.

The following marks were awarded for softness and matting after 5 washes:

1=very soft, no matting;
2=soft, slight matting;
3=moderately soft, distinct matting.

Marks of 1 to 3 were also awarded for cleanness as determined on standardized test stains using the same concentration of surfactant:

1=very good;
2=good;
3=satisfactory.

Three commercially available wool detergents were used for comparison.

Detergent I contained 19% of nonionic surfactant (fatty alcohol polyglycol ether) and 4% of dimethyl ditallow alkyl ammonium chloride.

Detergent II contained 23.5% of nonionic surfactant (fatty alcohol polyglycol ether) and 2.5% of quaternary ammonium salt (softener).

Detergent III contained 12.5% of alkyl benzene sulfonate, 7.5% of fatty alcohol diglycol ether sulfate, 1% of fatty acid diethanolamide and 1% of an ampholytic surfactant in addition to small quantites of sodium pyrophosphate.

| Detergent | Softness | Matting | Cleanness |
|---|---|---|---|
| Example 1 | 1 | 1 | 1–2 |
| Example 2 | 1 | 2 | 1–2 |
| Detergent I | 1–2 | 1–2 | 1–2 |
| Detergent II | 2 | 1–2 | 1–2 |
| Detergent III | 2 | 2 | 2 |

I claim:

1. A process for washing a fabric of wool or silk comprising the steps of

A. washing the fabric with a wash effective quantity of an aqueous liquid detergent composition free from inorganic builder salts and optical brighteners, and having a pH of from about 6 to about 8, said composition consisting essentially of (a) from about 5 to about 25% by weight of the sodium salt of an alkyl glycol ether sulfate of primary $C_{12}$–$C_{18}$-alcohols containing on average from 1 to 3 ethylene glycol ether groups, (b) from about 0.5 to about 5% by weight of a fatty acid monoethanolamide of $C_{12}$–$C_{18}$-fatty acids containing at least 50 mole % of saturated $C_{12}$–$C_{14}$-fatty acids, (c) from about 0.1 to about 1% by weight of an emulsified silicone defoamer, (d) from 0 to about 5% by weight of non-surface-active, non-alkaline detergent additives, and (e) remainder water, wherein the ratio by weight of component (a) to component (b) is between about 3:1 and about 50:1; and B. rinsing the fabric to remove the aqueous detergent composition therefrom.

2. A process in accordance with claim 1 wherein in A. the ratio of component (a) to component (b) is between about 3:1 and about 25:1.

3. A process in accordance with claim 1 wherein in A. the ratio of component (a) to component (b) is between about 4:1 and about 10:1.

4. A process in accordance with claim 1 wherein in A. from about 7 to about 20% by weight of component (a) is present.

5. A process in accordance with claim 1 wherein in A. from about 9 to about 15% by weight of component (a) is present.

6. A process in accordance with claim 1 wherein in A. from about 1 to about 4% by weight of component (b) is present.

7. A process in accordance with claim 1 wherein in A. from about 1.5 to about 3% by weight of component (b) is present.

8. A process in accordance with claim 1 wherein in A. from about 0.05 to about 0.5% by weight of component (c) is present.

9. A process in accordance with claim 1 wherein in A. from about 7 to about 20% by weight of component (a), from about 1 to about 4% by weight of component (b), and from about 0.05 to about 0.5% by weight of component (c) are present.

10. A process in accordance with claim 9 wherein from about 9 to about 15% by weight of component (a) and from about 1.5 to about 3% by weight of component (b) are present.

11. A process for washing woolen fabrics in a washing machine comprising the steps of A. washing a woolen fabric in a washing machine at a temperature in the range of from about 20° C. to about 40° C. and a wash liquor ratio based on kilograms of fabric to liters of wash liquor of from about 1:20 to about 1:50, wherein the wash liquor is water containing from about 2 to about 6 g/l of an aqueous liquid detergent which has a pH of from 6.5 to 7.5 and which consists essentially of (a) from about 5 to about 25% by weight of the sodium salt of an alkyl glycol ether sulfate of primary $C_{12}$–$C_{18}$-alcohols containing from 1 to 3 glycol ether groups, (b) from about 0.5 to about 5% by weight of a fatty acid monoethanolamide of $C_{12}$–$C_{18}$-fatty acids containing at least 50 mole % of saturated $C_{12}$–$C_{14}$-fatty acids, (c) from about 0.1 to about 1% by weight of an emulsified silicone defoamer, (d) from 0 to about 5% by weight of other non-surface-active non-alkaline detergent additives, and (e) remainder water, and wherein the liquid detergent is free from inorganic builder salts and optical brighteners and wherein the ratio by weight of component (a) to component (b) therein is between about 3:1 and about 50:1; and B. rinsing the fabric to remove the wash liquor therefrom.

12. A process in accordance with claim 11 wherein in A. the ratio of component (a) to component (b) is between about 3:1 and about 25:1.

13. A process in accordance with claim 11 wherein in A. the ratio of component (a) to component (b) is between about 4:1 and about 10:1.

14. A process in accordance with claim 11 wherein in A. from about 7 to about 20% by weight of component (a) is present.

15. A process in accordance with claim 11 wherein in A. from about 9 to about 15% by weight of component (a) is present.

16. A process in accordance with claim 11 wherein in A. from about 1 to about 4% by weight of component (b) is present.

17. A process in accordance with claim 11 wherein in A. from about 1.5 to about 3% by weight of component (b) is present.

18. A process in accordance with claim 11 wherein in A. from about 0.05 to about 0.5% by weight of component (c) is present.

19. A process in accordance with claim 11 wherein in A. from about 7 to about 20% by weight of component (a), from about 1 to about 4% by weight of component (b), and from about 0.05 to about 0.5% by weight of component (c) are present.

20. A process in accordance with claim 19 wherein from about 9 to about 15% by weight of component (a) and from about 1.5 to about 3% by weight of component (b) are present.

21. A process in accordance with claim 11 wherein in step A. the temperature is in the range of about 25 to about 35° C. and the liquor ratio is from about 25 to about 1:40.

* * * * *